US005623279A

United States Patent [19]

Itakura et al.

[11] Patent Number: 5,623,279

[45] Date of Patent: Apr. 22, 1997

[54] CAPACITIVE LOAD DRIVING CIRCUIT INCLUDING INPUT SELECTION CIRCUIT AND LIQUID CRYSTAL DISPLAY DEVICE USING THE DRIVING CIRCUIT

[75] Inventors: Tetsuro Itakura, Fujisawa; Takeshi Shima, Sagamihara, both of Japan

[73] Assignee: Kabushiki Kaisha Toshiba, Kawasaki, Japan

[21] Appl. No.: 304,544

[22] Filed: Sep. 12, 1994

[30] Foreign Application Priority Data

Sep. 10, 1993 [JP] Japan ..... 5-225284
Feb. 14, 1994 [JP] Japan ..... 6-017140

[51] Int. Cl.[6] ..... G09G 3/36; G09G 3/34

[52] U.S. Cl. ..... 345/98; 345/99; 345/100; 345/104; 345/95; 307/404; 327/94; 330/253

[58] Field of Search ..... 307/404; 327/94; 330/253; 345/98, 99, 100, 104, 95

[56] References Cited

U.S. PATENT DOCUMENTS 4,555,673 11/1985 Huijsing et al. ..... 330/258
5,006,739 4/1991 Kimura et al. ..... 307/270
5,162,670 11/1992 Itakura et al. ..... 307/353
5,280,199 1/1994 Itakura ..... 307/355
5,440,256 8/1995 Erhart et al. ..... 327/94
5,440,272 8/1995 Orisaka et al. ..... 330/253

FOREIGN PATENT DOCUMENTS 60-117500 6/1985 Japan .
2-304799 12/1990 Japan .

*Primary Examiner*—Raymond J. Bayerl
*Assistant Examiner*—Kuniki C. Lockett
*Attorney, Agent, or Firm*—Foley & Lardner

[57] ABSTRACT

A capacitative load driving circuit is provided in a liquid crystal display device and has an input selection circuit having a wide and effective voltage range of an input signal. The driving circuit changes over through source or emitter followers formed by two types of conductivity, for detecting as to whether or not a potential of the input signal is in an input voltage range of a differential amplifier circuit constituting a voltage follower after selecting at least one input signal through any of source or emitter followers.

7 Claims, 16 Drawing Sheets

CAPACITIVE LOAD DRIVING CIRCUIT INCLUDING INPUT SELECTION CIRCUIT AND LIQUID CRYSTAL DISPLAY DEVICE USING THE DRIVING CIRCUIT

BACKGROUND OF THE INVENTION

The present invention relates to a capacitive load driving circuit having an input selection circuit and a liquid crystal display device using the capacitive load driving circuit, and more particularly to an improved capacitive load driving circuit in which an input voltage range is extended.

Generally, as shown in FIG. 1, a liquid crystal display device comprises a liquid crystal display 1 in which a plurality of liquid crystal cells are arranged in a matrix shape, a liquid crystal display driving circuit 2 for supplying a video signal to the liquid crystal display 1 through a plurality of signal lines 3, and a scanning line selecting circuit 4 for selectively driving a plurality of scanning lines 5. The liquid crystal display 1 comprises a plurality of liquid crystal cells 6 which are arranged in a matrix shape including a first direction of the signal lines 3 and a second direction of the scanning lines 5, both the directions which are intersected in a right angle, namely, liquid crystal cells 6*aa*–6*mn* of "m×n" are provided and include m-th cells in the direction of the signal lines and n-th cells in the line of the scanning line.

The signal line 3 includes n-th signal lines 3*a*–3*n* each for supplying the video signal to the liquid crystal cells in the column direction, and the scanning line 5 includes m-th scanning line 5*a*–5*m* each for supplying the selection signal to the liquid crystal cells in the row direction. Accordingly, for example, the signal line 3*a* corresponds to the liquid crystal cells 6*aa*, 6*ba*, 6*ca*, . . . , 6(m–2)*a*, 6(m–1)*a* and 6*ma* in the column direction, and the scanning line 5*a* corresponds to the liquid crystal cells 6*aa*, 6*ab*, 6*ac*, . . . , 6*a*(n–2), 6*a*(n–1) and 6*an* in the row direction.

FIG. 2 shows an example of a general configuration of the display driving circuit 2 shown in FIG. 1. In FIG. 2, the display driving circuit 2 comprises a shift register 7 as sampling pulse transfer means, a selection signal line 8 including first and second selection signal lines 8*a*and 8*b* for supplying first and second selection signals SEL1 and SEL2, an AND circuit 9 for calculating a logical product between a sampling pulse and the selection signal, sample and hold circuits 10 having twice as many numbers as pixels necessary to on horizontal scanning line have, first and second switch groups 13 and 14 for selecting outputs of the sample and hold circuits 10 under a holding condition by the first and second selection signals SEL1 and SEL2, and buffer circuits 15 for driving the liquid crystal display 1 (FIG. 1) by a selected signal.

Since the second selection signal line 8*b* includes an inverting logic circuit (inverter) 8A, the second selection signal SEL2 in the signal line 8*b* is a signal which is generated by inverting the first selection signal SEL1 and has a level different from that of the first selection signal SEL1.

The AND circuit 9 includes AND circuits 9*a*1, 9*b*1, . . . , and 9*n*1 on one side for obtaining a logical product (an AND function) between the first selection signal SEL1 and the sampling pulse supplied from the shift register 7, and AND circuits 9*a*2, 9*b*2, . . . , and 9*n*2 on the other side for obtaining a logical product between the sampling pulse and the second selection signal.

Each of the sample and hold circuits 10 comprises a switch 11 for sampling the video signal to the liquid crystal display by a output of the AND circuit, and a capacitor 12 for holding the video signal of one horizontal scanning period, and the circuit 10 includes a plurality of sample and hold circuits 10*a*1, 110*a*2, 10*b*1, 10*b*2, . . . , 10*n*1, and 10*n*2 respectively corresponding to the AND circuits 9*a*1, 9*a*2, 9*b*1, 9*b*2, . . . , 9*n*1, and 9*n*2.

Outputs of the sample and hold circuits 10*a*1, 10*b*1, . . . , and 10*n*1 are supplied to switches 13*a*, 13*b*, . . . , and 13*n* which are turned on or off by the first selection signal SEL1, and outputs of the sample and hold circuits 10*a*2, 10*b*2, . . . , and 10*n*2 are supplied to switches 14*a*, 14*b*, and 14*n* which are turned on or off by the second selection signal SEL2.

The buffer circuit 15 includes a buffer circuit 15*a* to which the video signal is supplied through the switches 13*a* and 14*a*, a buffer circuit 15*b* to which the video signal is supplied through the switches 13*b* and 14*b*, as the same as above to a buffer in to which the video signal is supplied through the switches 13*n* and 14*n*. Outputs of the buffer circuits 15*a*, 15*b*, . . . , and 15*n* are supplied to each of cells in the liquid crystal display 1 through the signal lines 3*a*, 3*b*, . . . , 3*n*.

When an output signal of the selectively selected sample and hold circuit 10 is outputted through the buffer circuit 15, if the signal source has a low impedance, a simple switch circuit just selects an output signal of the sample and hold circuit. However, when the output of the sample and hold circuit is an input signal to the buffer circuit 15 through the switch 13 or 14 as shown in FIG. 3, the selection signals SEL1 and SEL2 impressed to the switches leaks out through parasitic capacitance 13A, 13B, 14A and 14B, thereby resulting the problem to generate an error in a held value. Furthermore, when the switches 13 and 14 is formed of a metal oxide semiconductor (MOS) field effect transistor (FET), channel charges of the MOS FET become a cause by adding with a holding capacitance 12 of the sample and hold circuit 10. Accordingly, in the case where the buffer circuit 15 having such switches 13 and 14 is used in the liquid crystal display driving circuit, errors occurring in the switch circuits make the picture quality to be deteriorated.

In FIG. 3, since a signal component held in the sample and hold circuit remains as charges in capacitance such as a wiring capacitance 16A from the switch circuits 13 and 14 to the buffer circuit 15 and an input capacitance 16B of the buffer circuit 15, after any output is selected by the switches 13 or 14, the output is interposed over the charges of the signal component which remain in the wiring capacitance 16A and the input capacitance 16B of the buffer circuit 15 in the past sampling, thereby resulting that the signal in the past sampling leaks out from the scanning line to the next scanning line on the liquid crystal display.

In order to avoid the above condition, the conventional device performs an impedance conversion by inserting source followers 17 and 18 before the selecting switches 13 and 14 as shown in FIG. 4. In FIG. 4, the output buffer portion 15 comprises a voltage follower having a similar source follower 19 which is provided on a negative feedback path to compensate a level shift by a gate-source voltage caused by the source followers 17 and 18 (refer to a detailed circuit diagram shown in FIG. 5).

In FIG. 5, the source follower 17 comprises a metal oxide semiconductor field effect transistor (MOS FET) M1 having a gate to which the first input signal INPUT1 is supplied, and a current source I1. A first switch 20 receives a source potential of the MOS FET Mi.

The source follower 18 comprises a MOS FET M2 having a gate to which the second input signal INPUT2 is supplied, and a current source I2, and a source potential of the MOS FET M2 is supplied to the second switch 14.

The buffer circuit 15 comprises a differential amplifier portion and an inverting amplifier portion, and the differential amplifier portion comprises a current source I3, a P-channel MOS FET M3 having a gate to which an output from the switch 13 or 14 is supplied, a P-channel MOS FET M4 constituting a differential pair with the MOS FET M3 and having a gate to which an output of a source follower 19 is supplied, and N-channel MOS FET M5 and M6 which are connected to the MOS FET M3 and M4, respectively, and having gates which are interconnected with each other. The inverting amplifier portion comprises a current source I4 and a N-channel MOS FET M7, and a drain potential of the MOS FET M7 is supplied to the liquid crystal display as an output signal OUTPUT and fed back to the source follower 19.

The source follower 19 comprises an N-channel MOS FET M8 having a gate to which a drain potential of the MOS FET M& is supplied, and a current source I5, and a source potential of the MOS FET M8 is fed back to a gate of the MOS FET M4.

However, since such above-mentioned method can not normally operate unless a voltage range of the input signals INPUT1 and INPUT2 is more than a threshold voltage $V_{th}$ of the N-channel MOS FET constituting the source follower when the source followers 17, 18 and 19 shown in FIG. 4 are constituted from the N-channel MOS FET, respectively, there is a problem that an effective voltage range of the input signals is limited. Accordingly, if the buffer circuit having the selection switches is applied to the liquid crystal driving circuit, it is necessary to provide a power source voltage at least more than the threshold voltage of the N-channel MOS FET because of an amplitude of the signal, thereby resulting a problem that power consumption increases.

SUMMARY OF THE INVENTION

In order to solve the above problems, an object of the present invention is to provide a buffer circuit having an input selection circuit, which has a wide and effective voltage range of the input signal.

Furthermore, another object of the present invention is to provide a liquid crystal display device in which the above buffer circuit is used to configure a driving circuit.

In order to achieve the above objects, a buffer circuit according to the present invention comprises input terminals of an n (n≧2) number, first through n-th source followers which are respectively formed by an FET of a first conductive type and have each input connected with each of the input terminals, (n+1)-th though 2n-th source followers which are respectively formed by an FET of a second conductive type and have each input connected with each of the input terminals, differential amplifier circuits each having two pairs of positive and negative inputs and operating by a signal inputted to any of the positive and negative inputs by a control signal, (2n+1)-th source followers formed by an FET of the first conductive type for inputting an output of the differential amplifier circuits, (2n+2)-th source followers formed by an FET of the second conductive type for inputting an output of the differential amplifier circuits, first switch means for selecting one of outputs of the first through n-th source followers formed by the FET of the first conductive type on the basis of a selection signal, second switch means for selecting one of outputs of the (n+1)-th through 2n-th source followers formed by the FET of the second conductive type on the basis of the selection signal, control signal generation means for generating a control signal from an operational potential of any of outputs of the first and second switch means, wherein an output of the first switch means is connected with a first positive input of the differential amplifier circuit, an output of the second switch means is connected with a second positive input of the differential amplifier circuit, an output of the (2n+1)-th source followers is connected with a first negative input of the differential amplifier circuit, and an output of the (2n+2)-th source followers is connected with a second negative input of the differential amplifier circuit.

According to an aspect of the present invention, in a liquid crystal display device having a liquid crystal display including a plurality of pixels, a plurality of signal lines and a plurality of scanning lines intersecting the signal lines for supplying a video signal to each of the pixels, sample and hold circuits of n (N≧2) being provided corresponding to each of the signal lines for supplying the video signal to the signal lines after sampling, buffer circuits for driving the signal lines by selecting an output of any of the sample and hold circuits, and the scanning line selection circuit, the buffer circuit comprises input terminals of n (n≧2) for receiving the outputs of the first through n-th (n≧2) sample and hold circuits, first through n-th source followers formed by an FET of a first conductive type and in which the input terminals are respectively connected to inputs thereof, (n+1)-th source followers formed by an FET of a second conductive type and in which the input terminals are respectively connected to inputs thereof, differential amplifier circuits each having two pairs of positive and negative inputs and operating by a signal inputted to any of the positive and negative inputs by a control signal, (2n+1)-th source followers formed by an FET of the first conductive type for inputting an output of the differential amplifier circuits, (2n+2)-th source followers formed by an FET of the second conductive type for inputting an output of the differential amplifier circuits, first switch means for selecting one of outputs of the first through n-th source followers formed by the FET of the first conductive type on the basis of a selection signal, second switch means for selecting one of outputs of the (n+1)-th through 2n-th source followers formed by the FET of the second conductive type on the basis of the selection signal, control signal generation means for generating a control signal from an operational potential of any of outputs of the first and second switch means, wherein an output of the first switch means is connected with a first positive input of the differential amplifier circuit, an output of the second switch means is connected with a second positive input of the differential amplifier circuit, an output of the (2n+1)-th source followers is connected with a first negative input of the differential amplifier circuit, and an output of the (2n+2)-th source followers is connected with a second negative input of the differential amplifier circuit.

Since the buffer circuit has the above configuration, the buffer circuit receives at least one input signal of the input signals which are selected through the source follower configured from the FET of the first conductive type and the source follower configured from the FET of the second conductive type, detects as to whether any of the outputs of the source followers configured from FET of any conductive type is within an input range of the differential amplifier circuit, and selects an input of the differential amplifier circuit by generating a control signal, thereby extending an input voltage range capable of normally driving the differential amplifier circuit constituting the buffer circuit. Furthermore, a voltage off-set by a gate-source voltage of the input source follower is usually cancelled by the source follower in the negative feedback of the differential amplifier circuit selected by the control signal.

As described above, since the differential amplifier circuit is driven by the input signal which is selected through the source follower usually included in the input voltage range of the differential amplifier circuit regardless of a potential of the first and second input signals INPUT1 and INPUT2, it is possible to realize a wide input voltage range.

Furthermore, when the capacitive load driving circuit according to the present invention is applied to a liquid crystal display driving circuit, since the driving circuit can prevent errors caused by an influence of the output selection switches of the sample and hold circuit and a leakage of the signal in the scanning line caused by the past sampling even though the power consumption does not increase, it is possible to realize a very accurate liquid crystal display.

DETAILED DESCRIPTION OF THE PREFERRED EMBODIMENTS

There will be described in detail a capacitive load driving circuit and a liquid crystal driving circuit using the driving circuit according to preferred embodiments of the present invention in reference with the attached drawings.

Figure 6:
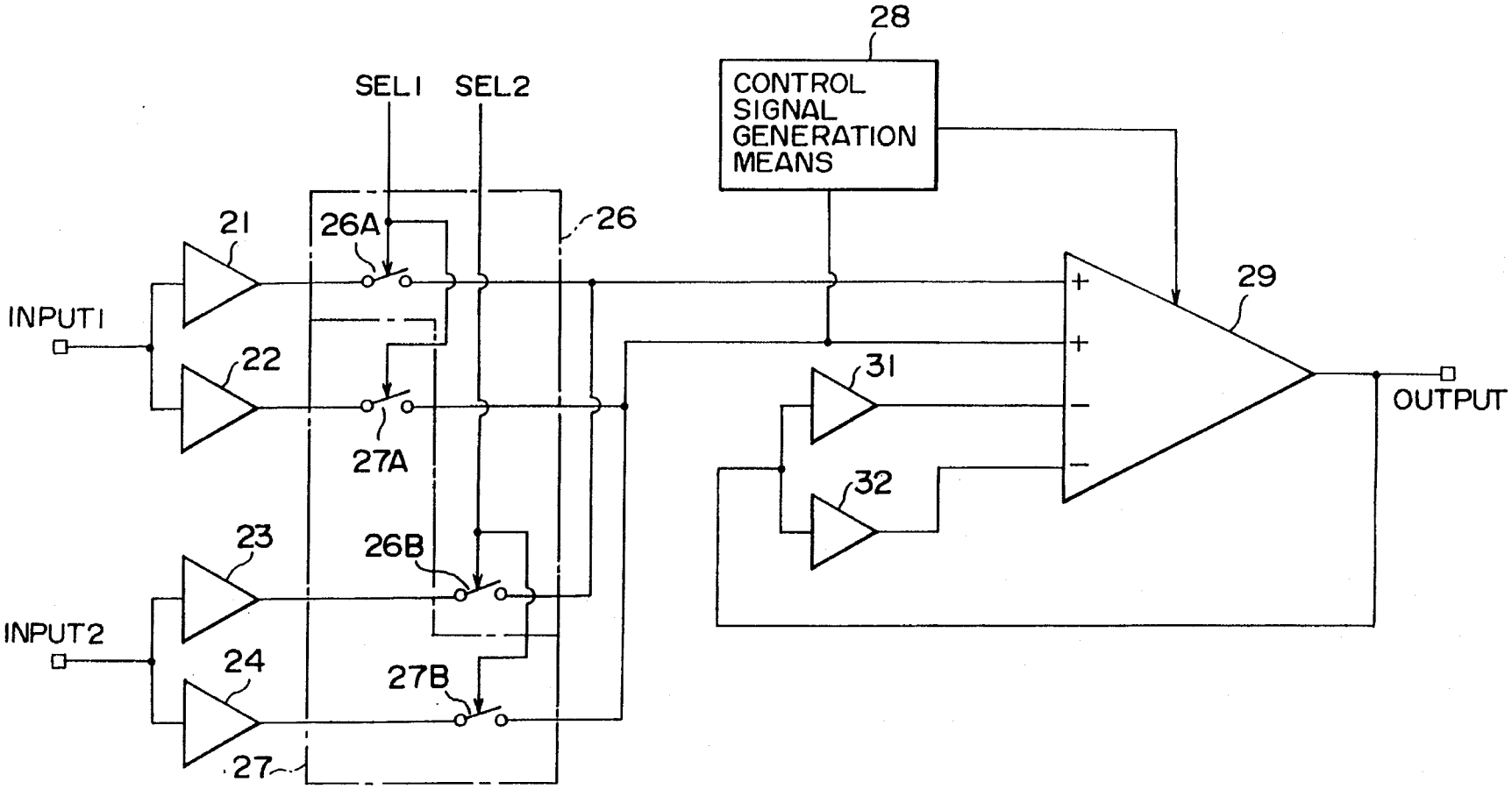
FIG. 6 is a block diagram showing a capacitive load driving circuit according to a first embodiment of the present invention.

FIG. 6 shows a block diagram of a capacitive load driving circuit according to a first embodiment of the present invention. The first embodiment is the case where a number of input signals is two.

As shown in FIG. 6, input; signals INPUT1 and INPUT2 are selected in switches 26A and 26B by selection signals SEL1 and SEL2 through source followers 21 and 23 which are respectively configured by an N-channel MOS FET. The input signals INPUT1 and INPUT2 are also selected in switches 27A and 27B by the selection signals SEL1 and SEL2 through source followers 22 and 24 which are respectively configure by a P-channel MOS FET. The input signals selected in the switches 26A and 26B are supplied to a first positive input terminal of a differential amplifier circuit 29, while the input signal selected in the switches 27A and 27B are supplied to a second positive input terminal of the differential amplifier circuit 29 and at the same time to control signal generation means 28. An output of the differential amplifier circuit 29 is supplied to first and second negative input terminals through a source follower 31 of an N-channel MOS FET and a source follower 32 of a P-channel MOS FET, respectively. The control signal generation means 28 generates a control signal which causes the differential amplifier circuit 29 to be operated by selecting at least one pair of two pairs of the differential inputs which are impressed to the differential amplifier circuit 29.

Next, there is described operation of the capacitive load driving circuit according to the first embodiment of the present invention. Since the input signals INPUT1 and INPUT2 are selected by the selection signals SEL1 and SEL2 after passing through the source followers comprised of the N-channel MOS FET and P-channel MOS FET, respectively, the source follower 21 or 23 of the N-channel MOS FET normally operates when a potential of the selected input signal is high, while the source follower 22 or 24 of the P-channel MOS FET normally operates when a potential of the selected input signal is low. In this manner, the differential amplifier circuit 29 usually receives the selected input signals through the source followers which normally operate at least one side.

In the first embodiment shown in FIG. 6, the control signal generation means 28 detects as to whether or not an output of the source followers of the P-channel MOS FET is in the input voltage range of the differential amplifier circuit 29 on the basis of an operational potential of the input signal which is selected by the source follower of the P-channel MOS FET, and selects any of the input signals selected by the source followers of the N-channel MOS FET and the P-channel MOS FET to operate the differential amplifier circuit 29.

At this time, the control signal generation means 28 selects any of two outputs from the source followers of the N-channel MOS FET and the P-channel MOS FET by the selection signal to operate the differential amplifier circuit 29 in order to correct a level shift component caused by the gate-source voltage occurring by the source follower at the previous stage of the input signal changeover switch, in which one is outputted from the source followers of the N-channel MOS FET and the other is outputted from the source followers of the P-channel MOS FET, and both source followers are provided in the negative feedback path. Accordingly, since the differential amplifier circuit 29 is driven by the input signals which are selected by the source followers and usually included in the input voltage range of the differential amplifier circuit 29, it is possible to realize a wide input voltage range.

Figure 1:
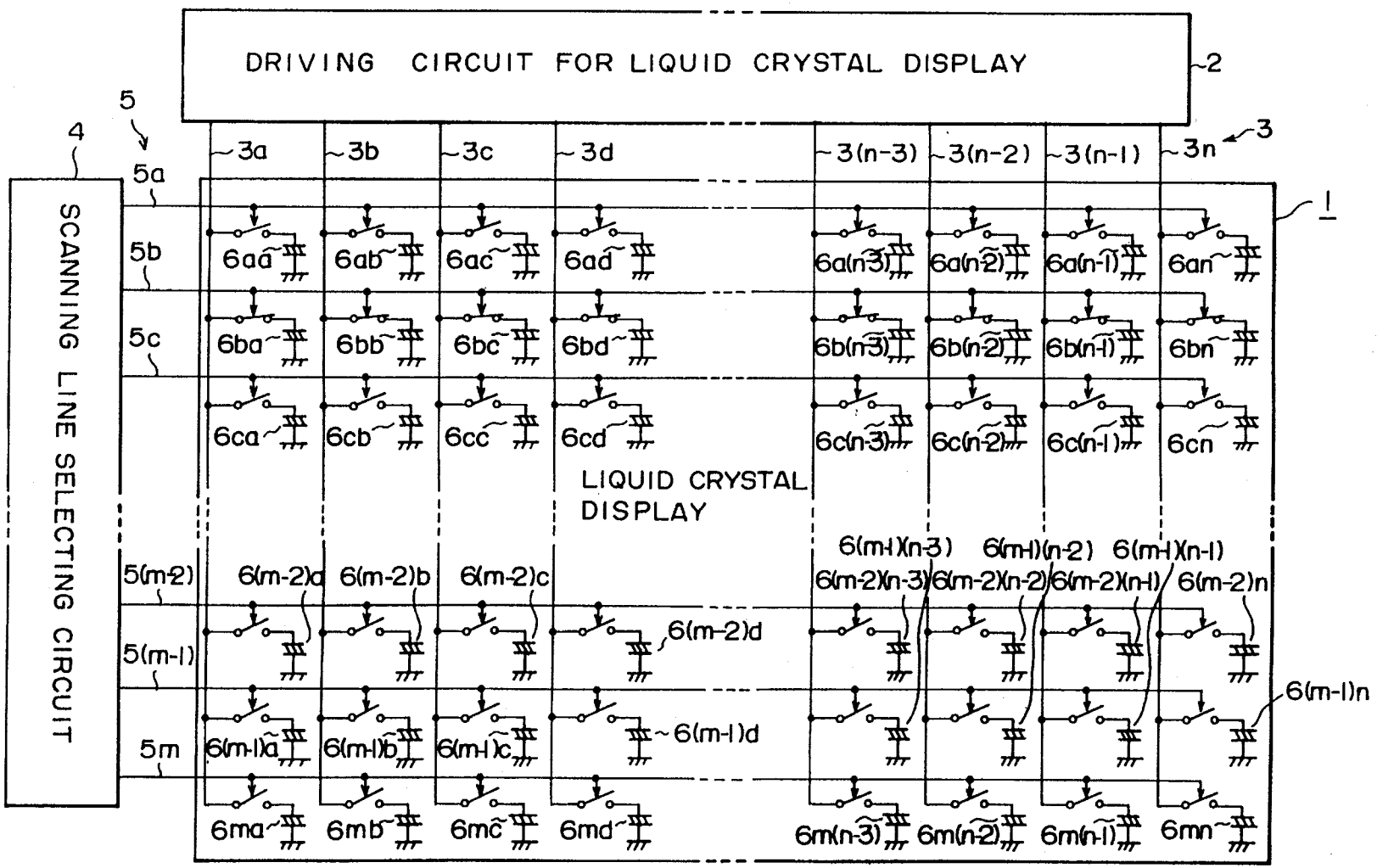
FIG. 1 is a block diagram showing a general configuration of a liquid crystal display device.
Figure 2:
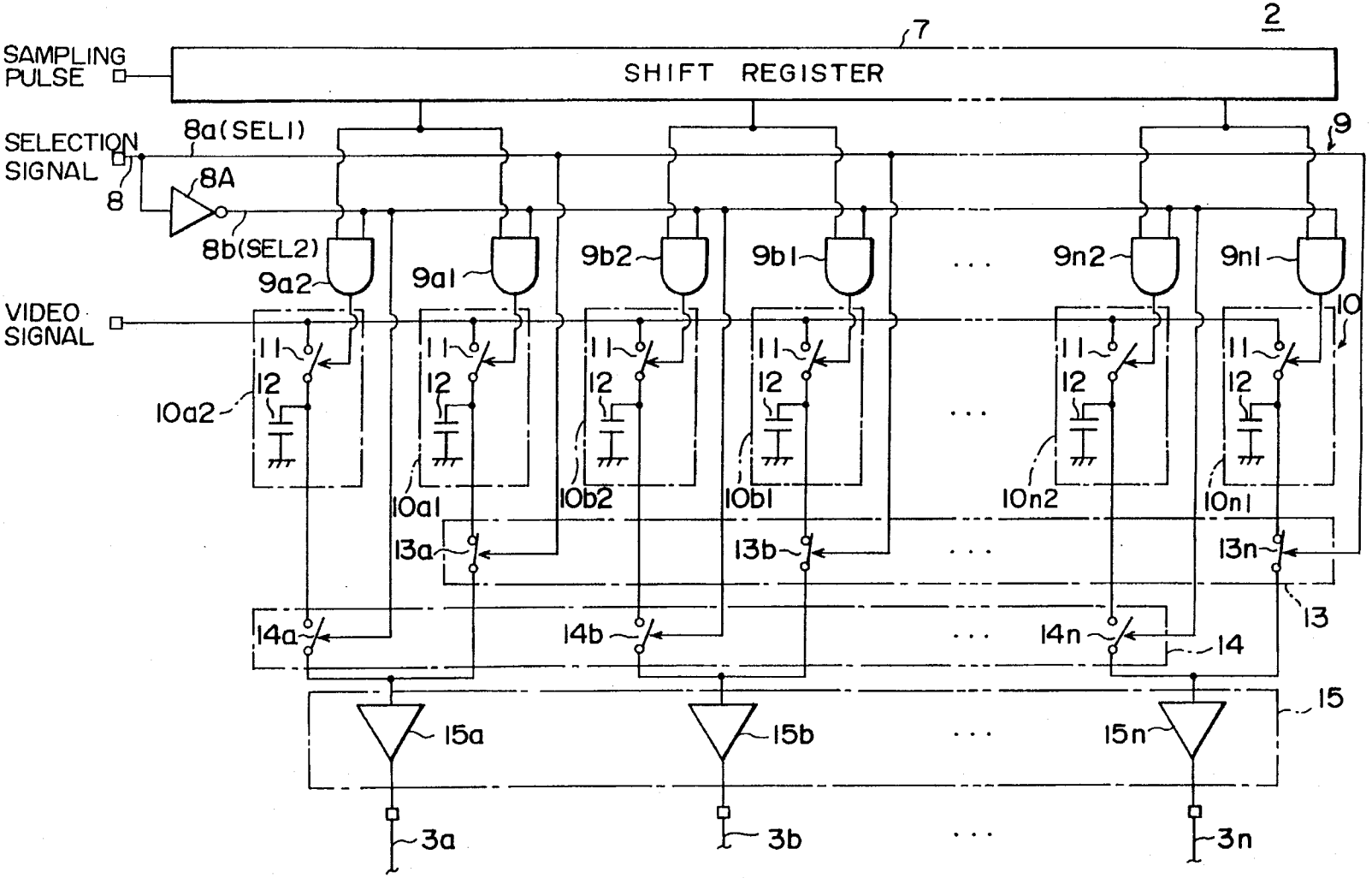
FIG. 2 is a block diagram showing a configuration of a general liquid crystal display driving circuit.
Figure 3:
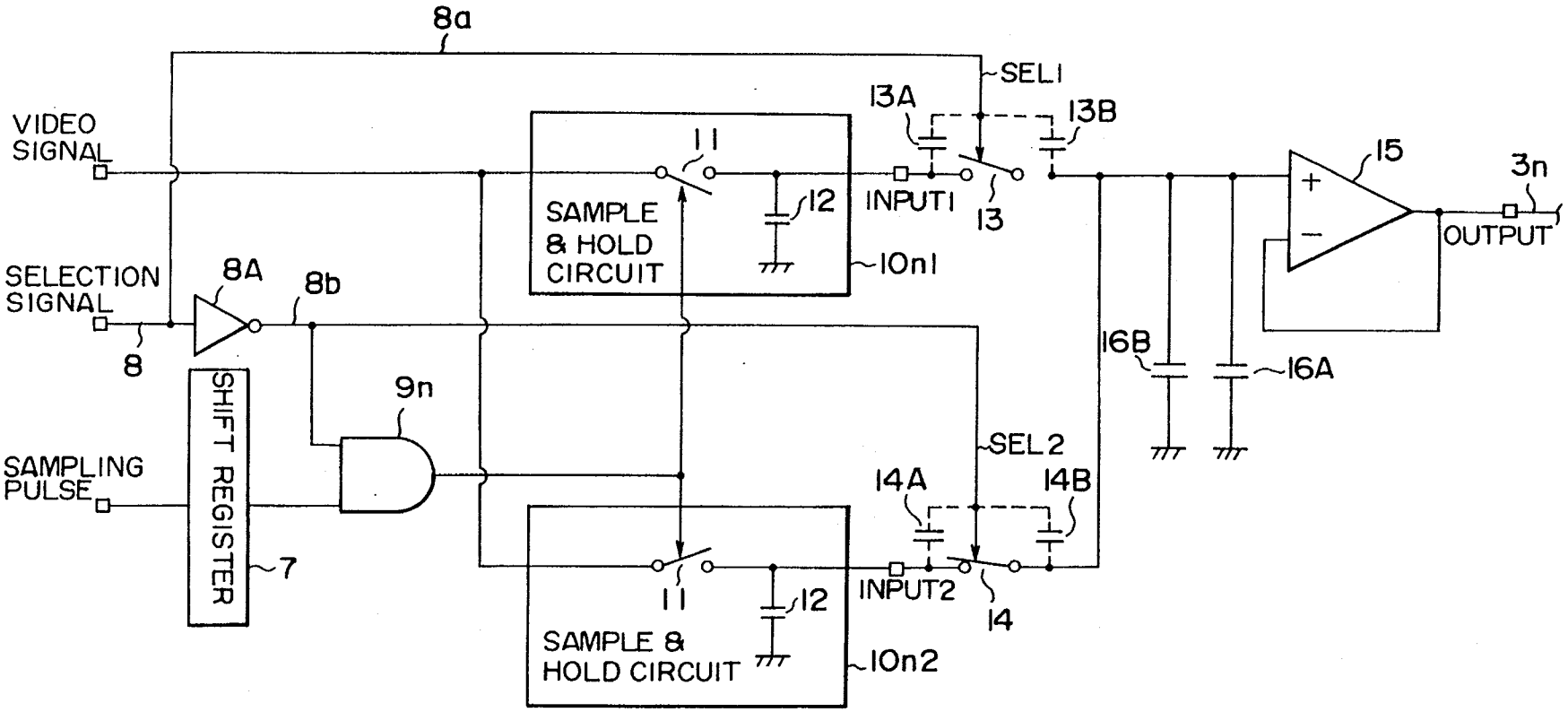
FIG. 3 PRIOR ART
FIG. 3 is a block diagram for explaining a problem of the conventional driving circuit.
Figure 4:
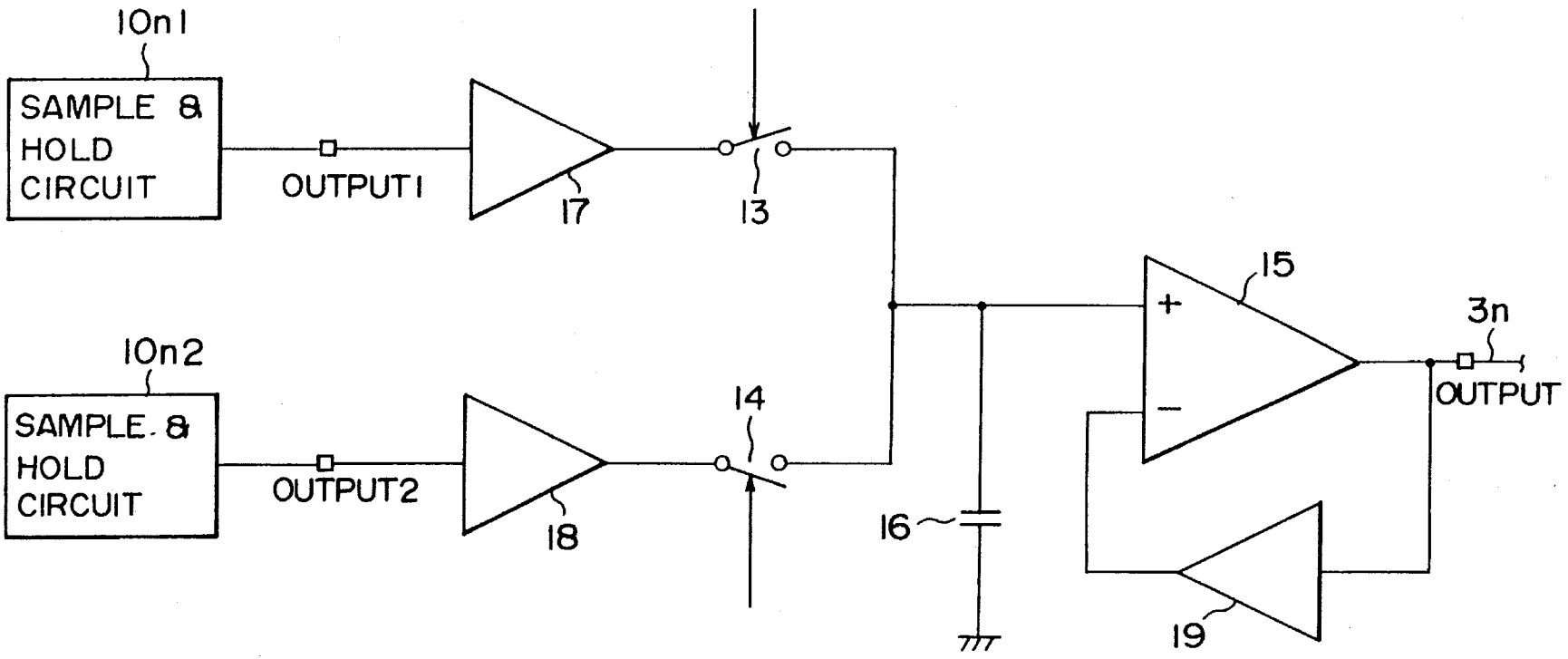
FIG. 4 PRIOR ART
FIG. 4 is a block diagram showing a conventional buffer circuit.
Figure 5:
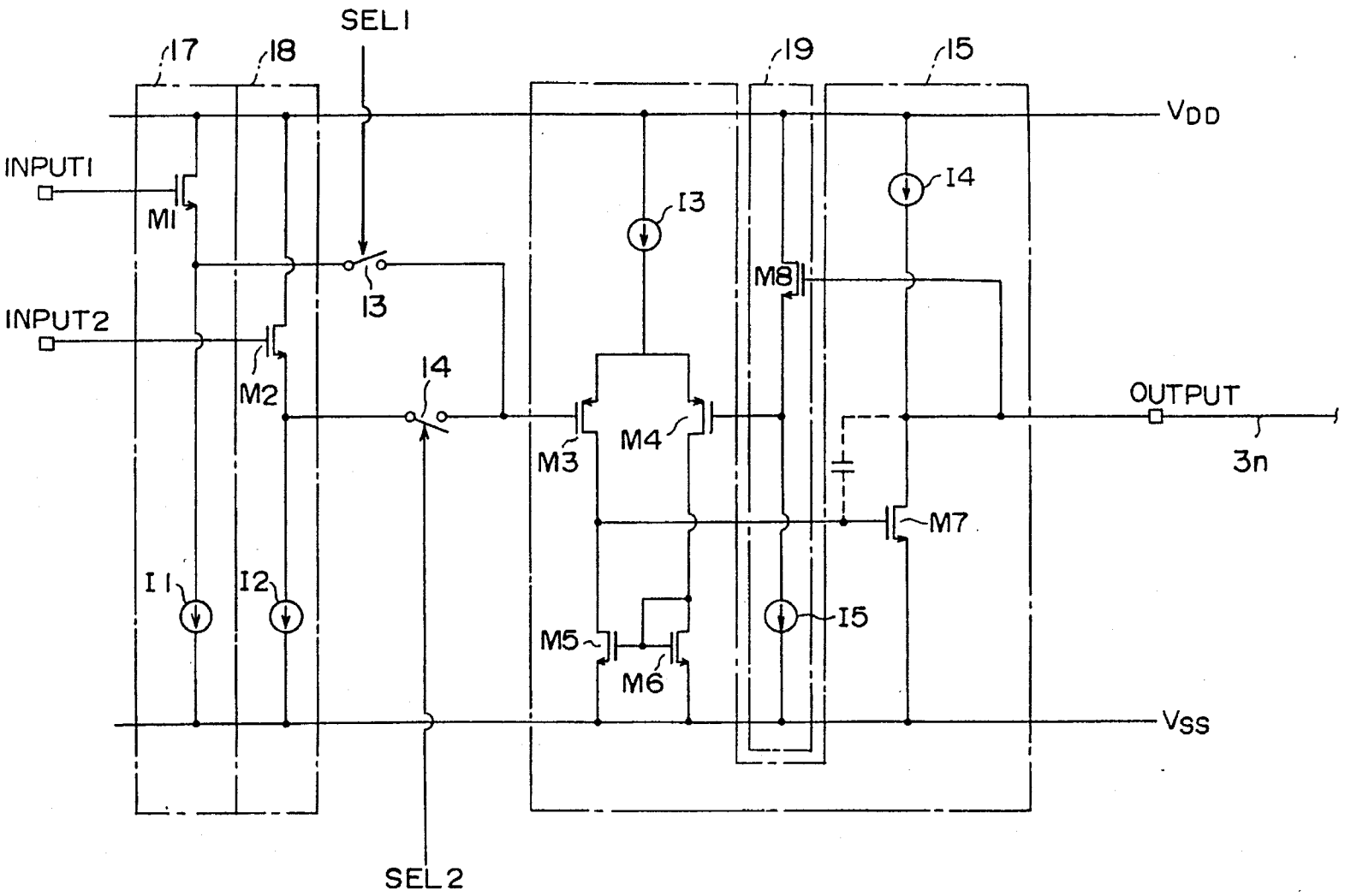
FIG. 5 PRIOR ART
FIG. 5 is a block diagram showing the conventional driving circuit shown in FIG. 3.

Furthermore, when the capacitive load driving circuit is applied to the buffer circuit and the switches for selecting the sample and hold circuit in the liquid crystal display driving circuit shown in FIG. 2, it is possible to realize a liquid crystal display driving circuit having a wide operation voltage range without receiving an influence of an error of the channel charge when the switch for selecting the sample and hole circuit is turned off. If such liquid crystal driving circuit is used in the liquid crystal display device, it is possible to realize a display having very accurate operation, and since it is unnecessary to increase a power source voltage, the power consumption does not increase.

Figure 7:
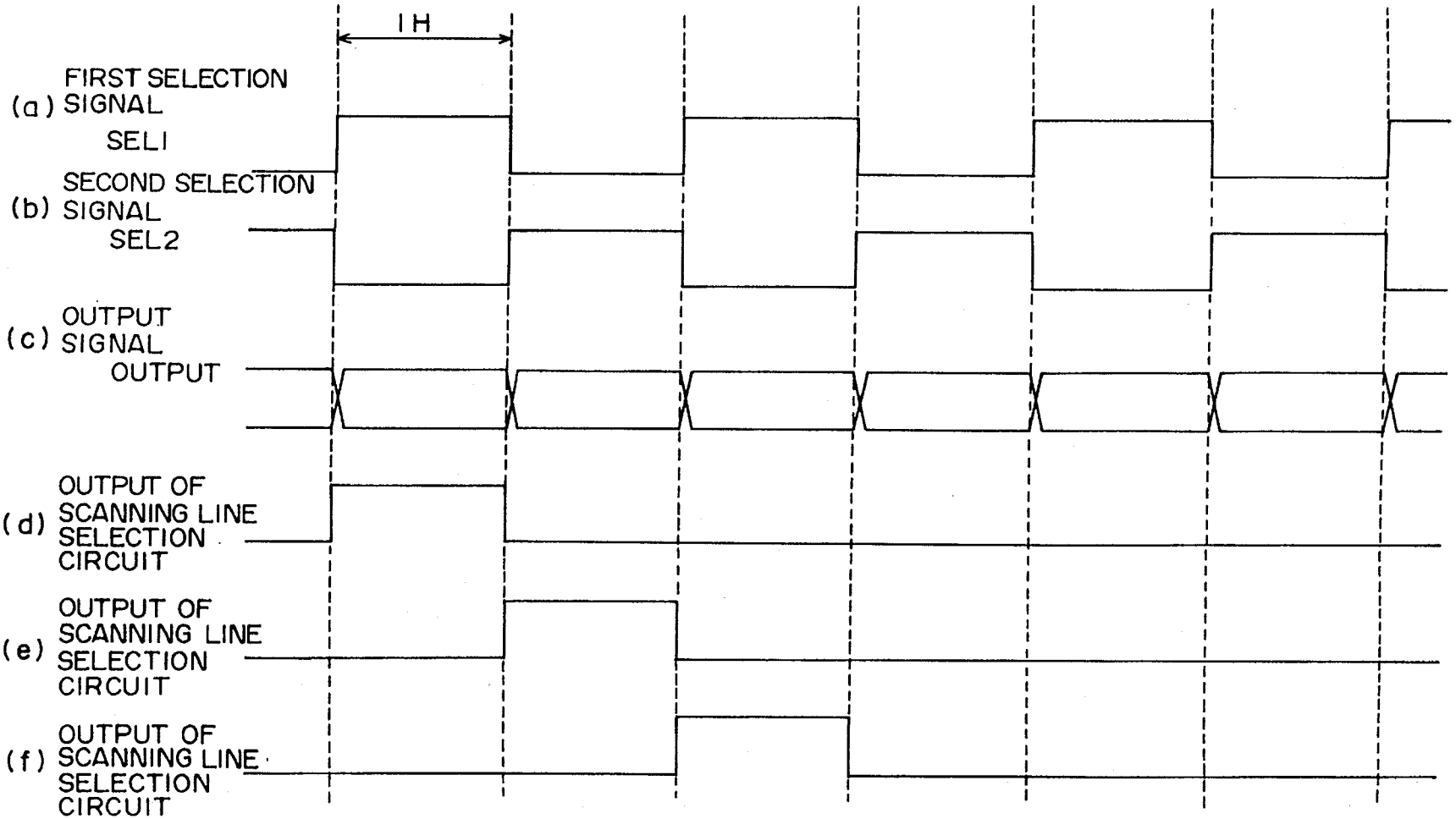
FIG. 7 is a timing chart showing respective timing of each portion of the driving circuit shown in FIG. 6.

As shown in FIG. 2, the selection signal line 8 includes a first signal line 8*a*for supplying the first selection signal SEL1, and a second signal line 8*b* for supplying the second selection signal SEL2. Since the second signal line 8*b* has an inverting logic circuit (an inverter) 8A, the first and second selection signal SEL1 and SEL2 are shown as waveforms (a) and (b) in timing charts shown in FIG. 7. Signal data (c) shown in FIG. 7 are an output signal OUTPUT of the buffer circuit, and waveforms (d), (e) and (f) show timing of the scanning line signals which are outputted from the scanning line selection circuit 4 to successive three scanning lines.

Figure 8:
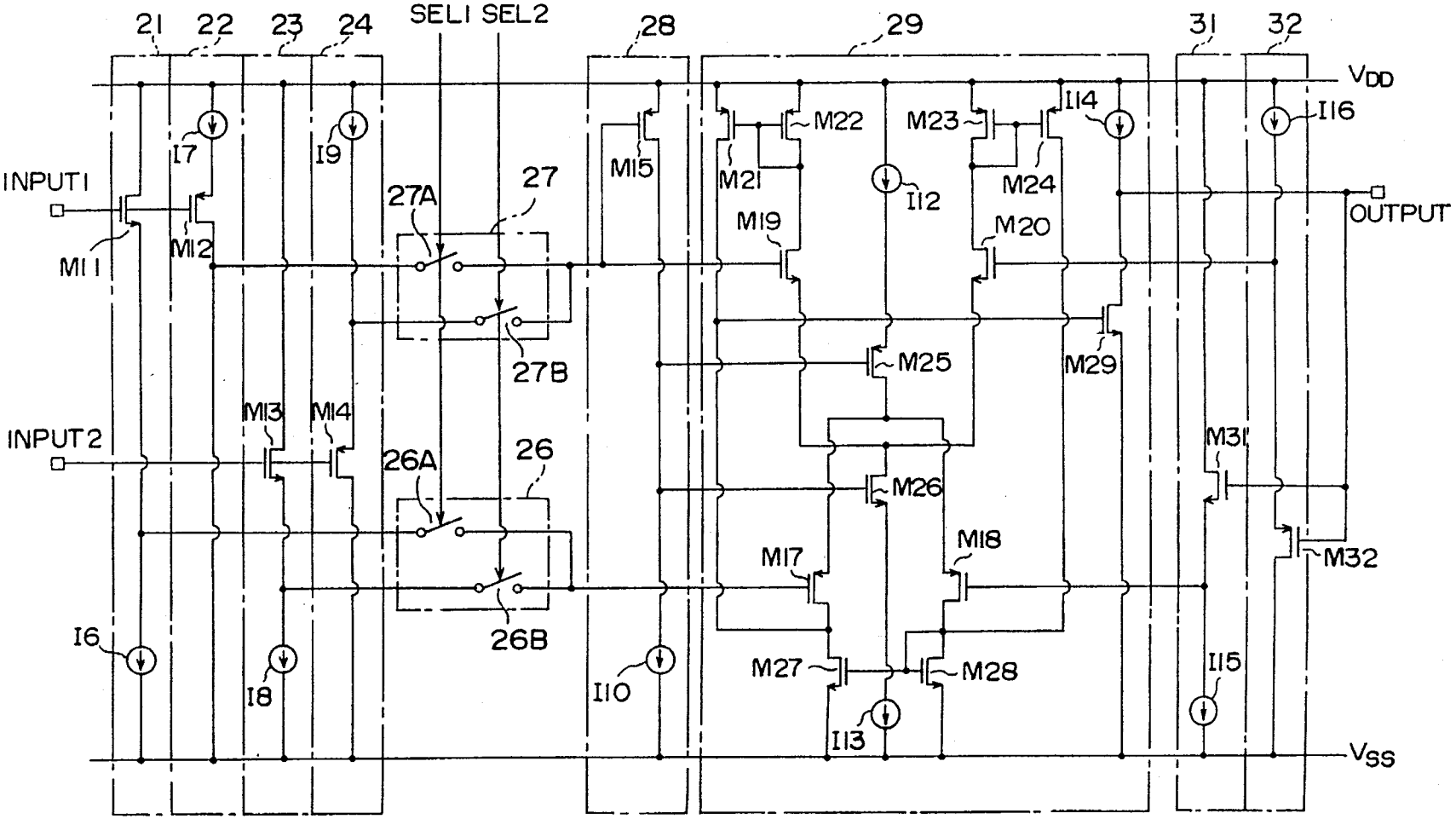
FIG. 8 is a circuit diagram showing a capacitive load driving circuit according to a second embodiment as a concrete example of the driving circuit of the first embodiment.

FIG. 8 shows a circuit of a capacitive load driving circuit according to a second embodiment of the present invention as a detailed example of the first embodiment. In FIG. 8, source followers 31, 32, and 21–24 are respectively comprised of transistors M31, M32 and M21–M24, and current sources I15, I16 and I6–I9. The differential amplifier circuit 29 comprises current sources I12 and I13, a first differential pair M17 and M18, and a second differential pair M19 and M20, switching transistors M25 and M26 for determining to operate any of the first and second differential pairs, transistors M21–M24 constituting a current mirror for returning back a differential output signal of the first differential pair, transistors M27 and M28 constituting an active load, and a transistor M29 and a current source I14 constituting an inverting amplifier. The control signal generation means 28 comprises a potential detecting transistor M15 and a current source I10.

In the second embodiment shown in FIG. 8, in two pairs of the differential amplifiers forming an input portion of the differential amplifier circuit 29, since one pair uses a P-channel MOS FET and the other pair uses an N-channel MOS FET, input voltage ranges of normal operation of both pairs are different from each other. When there is a high potential of an input signal which is selected by switches 27A and 27B through the source followers of the P-channel MOS FET and there is an off-condition of the potential detecting transistor M25 in the control signal generation means 28, an output potential of the control signal generation means 28 becomes low substantially to a potential $V_{SS}$ by means of the current source I10. Accordingly, the transistor M25 is turned on, a current of the current source I12 flows into sources of the transistors M17 and M18 constituting the differential pair.

Furthermore, the transistor M26 is turned off so as to make the differential pair comprised of the transistors M19 and M20 also be turned off. Since an input signal impressed to the differential pair constituted from the transistors M17 and M18, is selected by the source follower of the N-channel MOS FET, a level of the input signal is shifted to be low for a gate-source voltage of the N-channel MOS FET. Accordingly, it is possible to keep the threshold voltage for operating the transistors M17 and M18, thereby normally operating the differential amplifier circuit 29.

When there is a low potential of the input signal which is selected through the source follower of the P-channel MOS FET by the switches 27A and 27B in an ON-condition of the potential detecting transistor 15 of the control signal generation means 28, an output potential of the control signal generation means 28 becomes high substantially to a potential $V_{DD}$. At this time, the transistor M25 is turned off, and the differential pair comprised of the transistors M17 and M18 is turned off. Since the transistor M26 is turned on, a current from the current source I13 flows into sources of the transistors M19 and M20 through the transistor M26. Since the input signal supplied to the differential pair comprised of the transistors M19 and M20 is selected through the source follower by the P-channel MOS FET, a level of the input signal is shifted for the gate-source voltage of the P-channel MOS FET. Accordingly, it is possible to keep the threshold voltage for operating the transistors M19 and M20, thereby normally operating the differential amplifier circuit 29.

Figure 9:
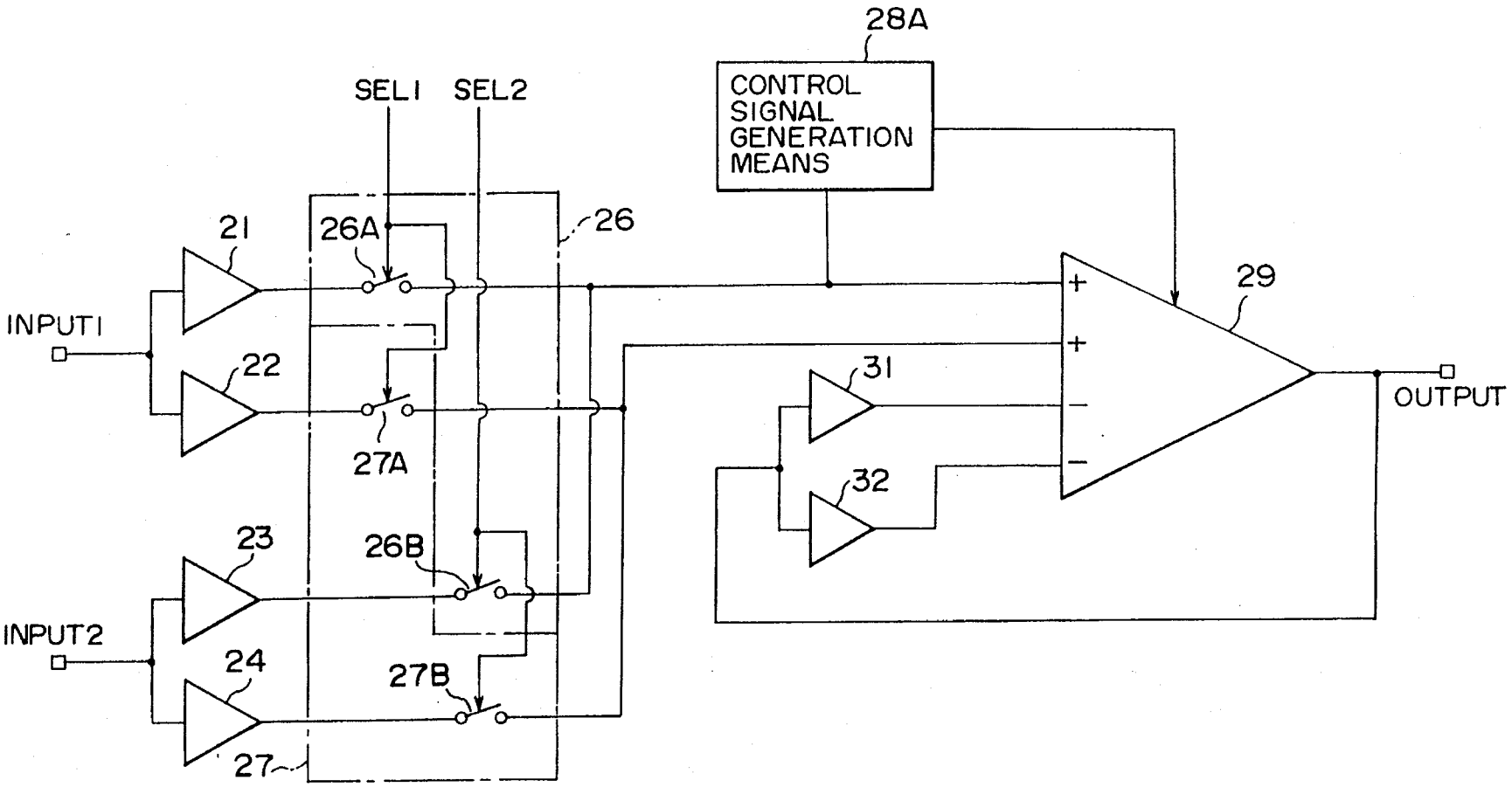
FIG. 9 is a block diagram showing a capacitive load driving circuit according to a third embodiment of the present invention.

Next, there is described a capacitive load driving circuit according to a third embodiment in reference with FIG. 9. The capacitive load driving circuit of the third embodiment comprises control signal generation means 28A for receiving an output of the first switch 26, which is in the place of the control signal generation means 28 for receiving an output of the switch 27 as an input such as the driving circuit according to the first embodiment. Since other components are the same as the driving circuit according to the first embodiment, a duplicate description will be omitted.

Figure 10:
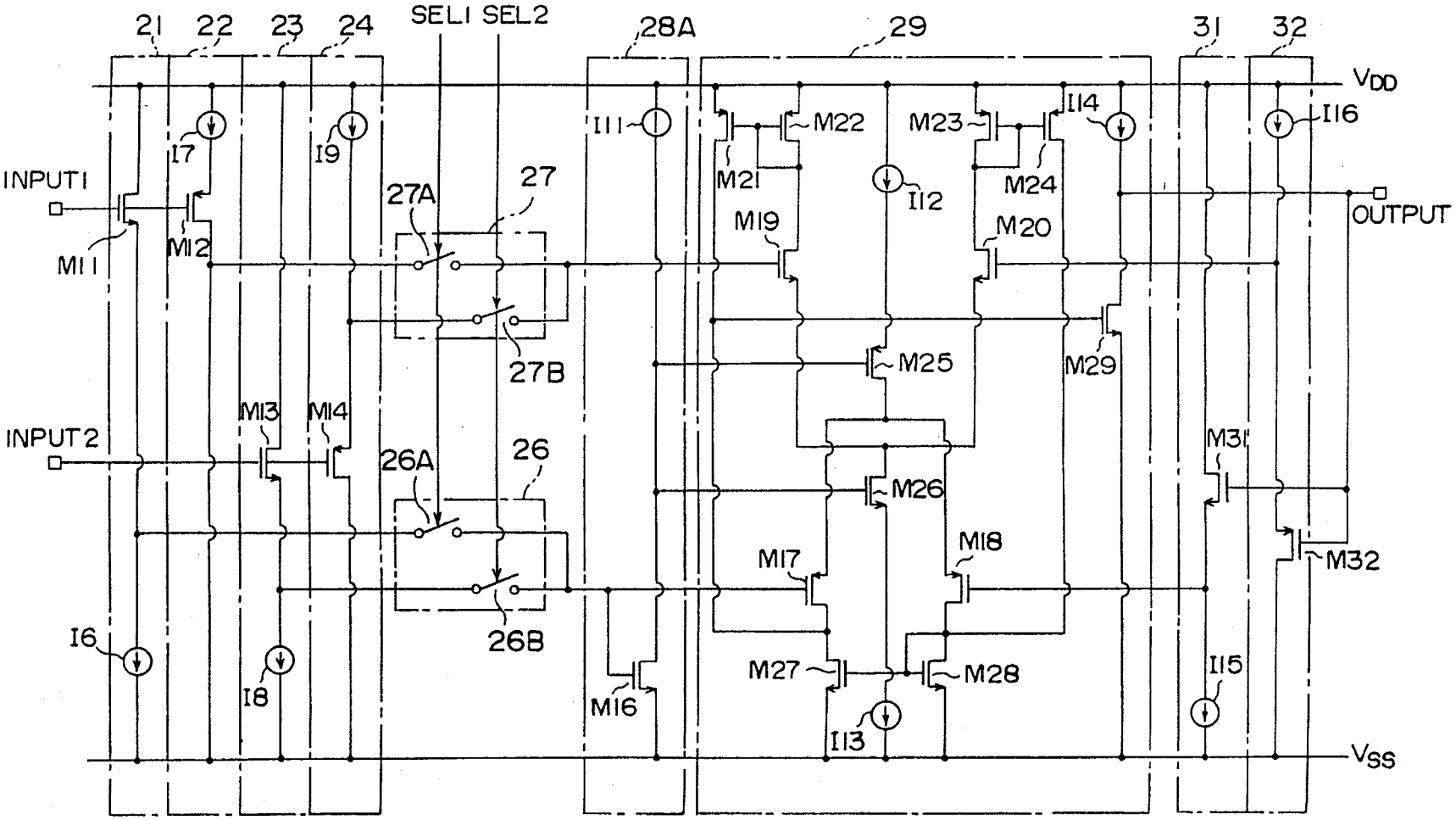
FIG. 10 is a circuit diagram showing a capacitive load driving circuit according to a fourth embodiment as a concrete example of the driving circuit of the third embodiment.

Furthermore, FIG. 10 is a circuit diagram showing a capacitive load driving circuit according to a fourth embodiment as an example of the capacitive load driving circuit according to the third embodiment shown in FIG. 9. In FIG. 10, the control signal generation means 28A comprises a current source Ill and an N-channel MOS FET M16. An output selected by the first switch 26 is supplied to a gate of a P-channel MOS FET constituting the first differential pair, and at the same time to a gate of the MOS FET M16. A junction voltage between the current source I11 and the MOS FET M16 is supplied to a gate of the switching transistor M25 of the first differential pair and to a gate of the switching transistor M26 of the second differential pair, respectively. Since other components are the same as driving circuit according to the second embodiment shown in FIG. 8, a duplicate description will be omitted.

Figure 11:
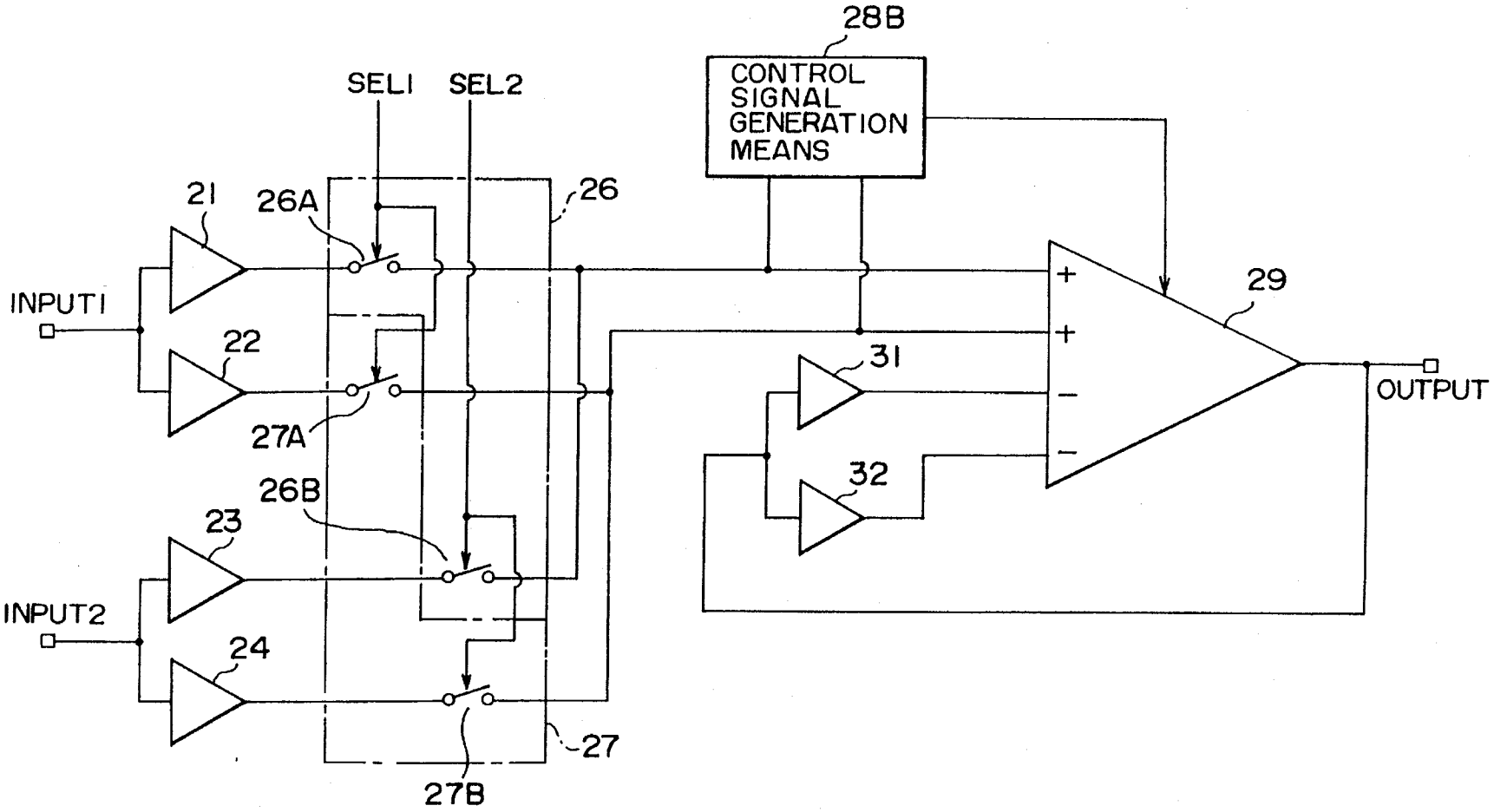
FIG. 11 is a block diagram showing a capacitive load driving circuit according to a fifth embodiment of the present invention.

Next, there is described a capacitive load driving circuit according to a fifth embodiment of the present invention as shown in FIG. 11. The driving circuit according to the fifth embodiment is made by combining the capacitive load driving circuits according to the first and third embodiments, in which the input of control signal generation means 28B is supplied from both of the first and second switches 26 and 27. By the configuration of this, it is possible for operation of the N-channel source follower to be accurate, thereby turning on operation of the P-channel differential pair within the input range of the P-channel differential pair in the differential amplifier circuit 29. Therefore, it is possible to reduce switching noises when the input differential pair of the differential amplifier circuit 29 is changed over.

Figure 12:
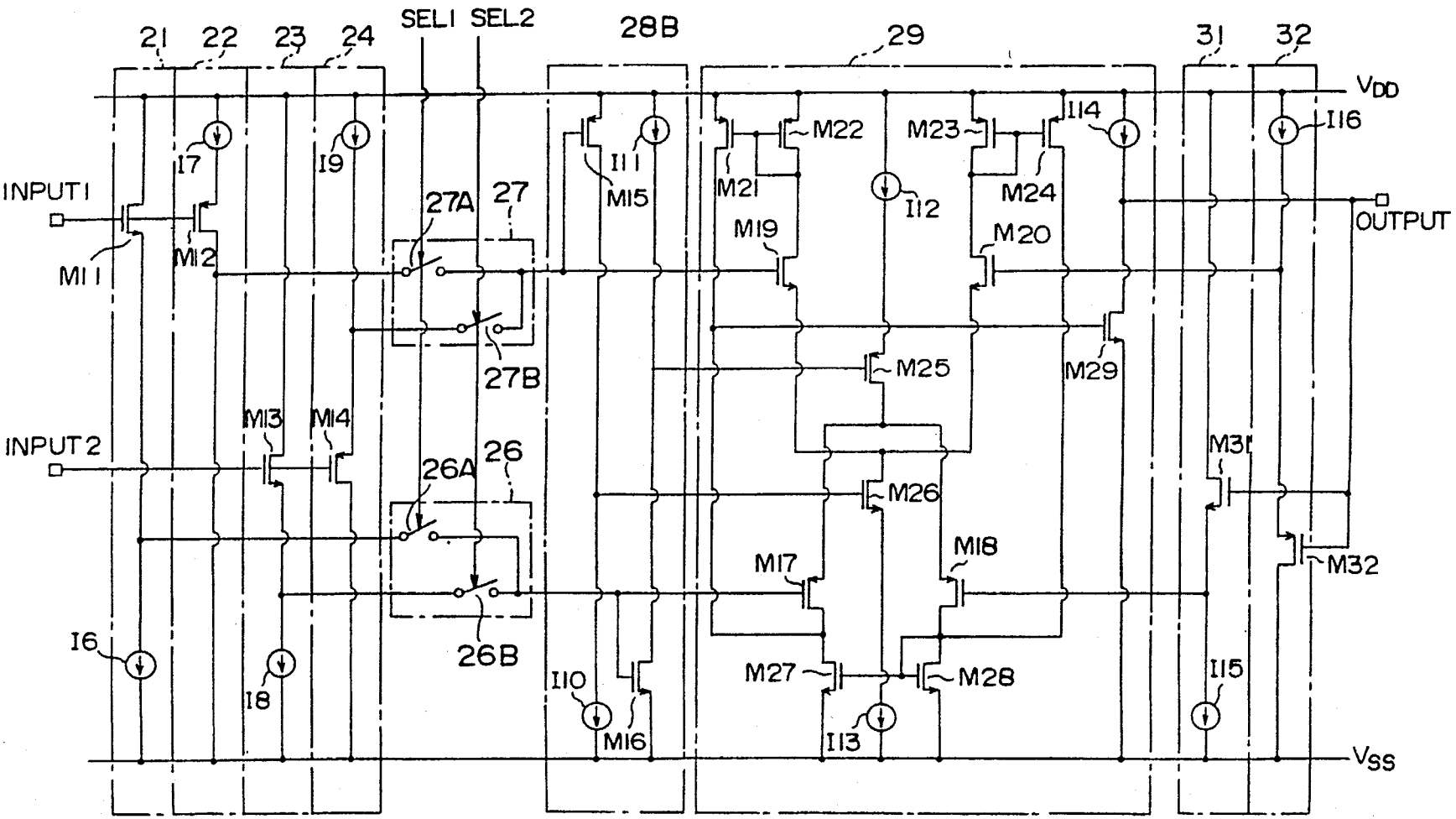
FIG. 12 is a circuit diagram showing a capacitive load driving circuit according to a sixth embodiment as a concrete example of the driving circuit of the fifth embodiment.

FIG. 12 is a circuit diagram showing a capacitive load driving circuit according to a sixth embodiment of the present invention as an example of the fifth embodiment shown in FIG. 11. In FIG. 12, the control signal generation means 28B comprises a current source I10 and a potential detecting P-channel MOS PET M15 having a gate for receiving an output of the second switch 27, and a current source I11 and a potential detecting N-channel MOS PET M16 having a gate for receiving an output of the first switch 26. A junction potential between the PET M16 and the current source I11 is supplied to a gate of a switching FET M25 of the first differential pair PET M17 and M18 of the differential amplifier 29, while a junction potential between the PET M15 and the current source I10 is supplied to a gate of a switching PET M26 of the second differential pair PET M19 and M20 of the differential amplifier 29.

Since other components are the same as those in the relevant description of FIGS. 8 and 10, a duplicate description is omitted.

Figure 13:
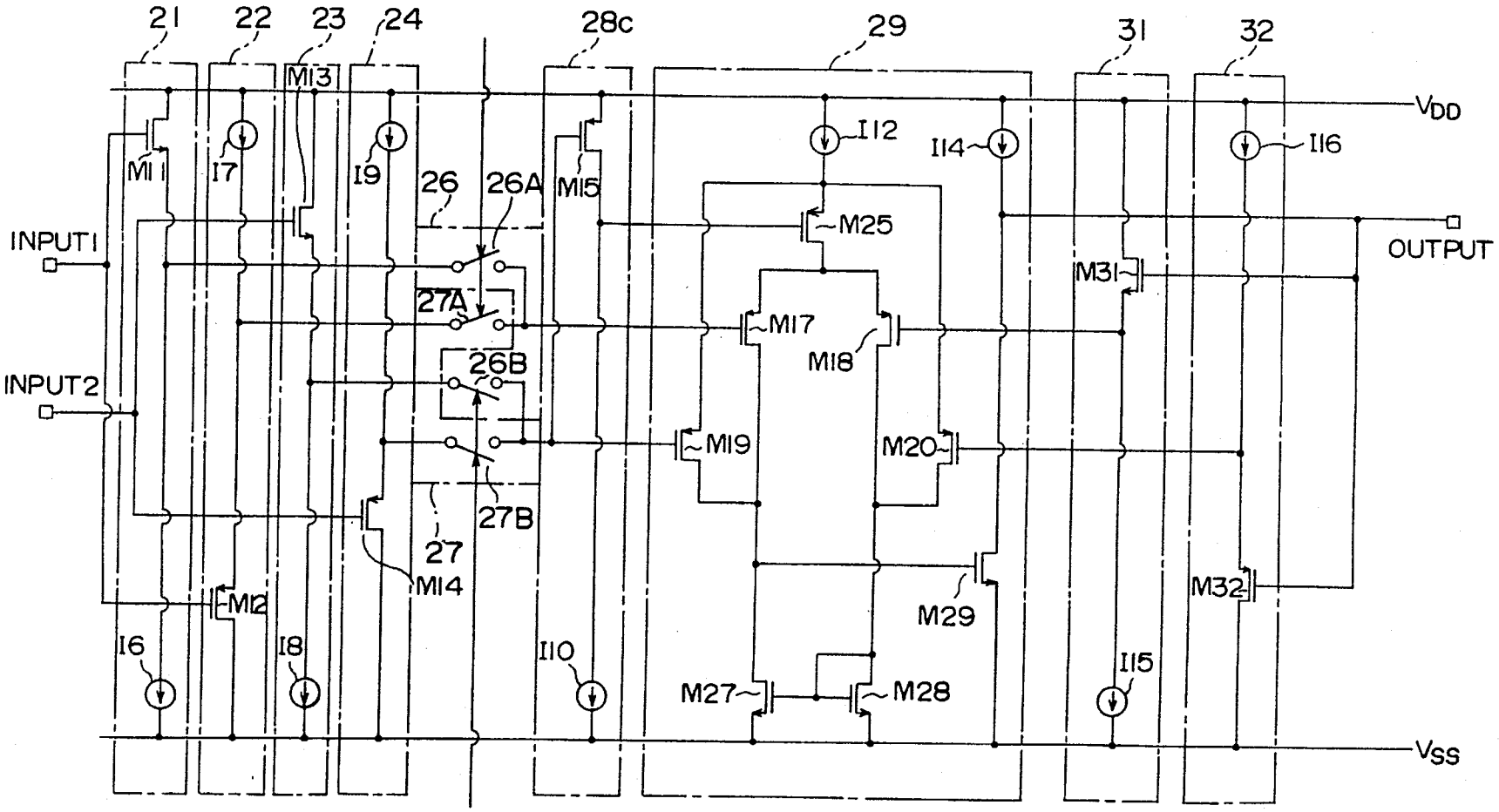
FIG. 13 is a circuit diagram showing a capacitive load driving circuit according to a seventh embodiment as another concrete example of the driving circuit of the first embodiment.

FIG. 13 is a circuit diagram showing a capacitive load driving circuit according to a seventh embodiment of the present invention as an example of the first embodiment. In FIG. 13, source followers 21, 22, 23, 24, 31 and 32 are comprised of transistors M11, M12, M13, M14, M31 and M32 and current sources I6, I7, I8, I15 and I16, respectively. The differential amplifier circuit 29 comprises a current source I12, a first differential pair M17 and M18, a second differential pair M19 and M20, a switching transistor M25 for determining as to which differential pair should be operated, transistors M27 and M28 constituting a common active load of the differential pairs, and a MOS FET M29 and a current source I14 constituting an inverting amplifier. Control signal generation means 28C comprises a potential detecting transistor M15 and a current source I10.

In the seventh embodiment shown in FIG. 13, since two pairs of the differential pairs constituting an input portion of the differential amplifier circuit 29 use a P-channel MOS FET, input voltage ranges for normally operating are similar to each other. When there is a high potential of the input signal which is selected through the source follower of the P-channel MOS FET by the switches 26 and 27 in the case where the transistors M19 and M20 constituting the differential pair are turned off because the threshold voltage can not be kept for normally operating, a potential detecting transistor M15 is also turned off in the control signal generation means 28C, thereby reducing the output voltage of the control signal generation means 28C substantially to the potential $V_{SS}$ by the current source I10. Accordingly, since the transistor M15 acquires an ON-state, the current of the current source I12 flows through the MOS FET M15 into sources of the transistors M17 and M18 constituting the differential pair. Since an input signal supplied to the differential pair comprised of the transistors M17 and M18 is selected through the source follower of the N-channel MOS FET, a level of the input signal is shifted for a gate-source voltage of the N-channel MOS FET. Accordingly, it is possible for the transistors M17 and M18 to keep the threshold voltage for operating the transistors M17 and M18, and the differential amplifier circuit 29 normally operates.

Furthermore, when there is a low potential of the input signal selected through the source follower of the P-channel MOS FET in the case where the transistors M19 and M20 constituting the differential pair normally operate, the potential detecting transistor M15 in the control signal generation means 28C is also in ON-state, an output potential of the control signal generation means 28C becomes substantially the voltage $V_{DD}$. At this time, the transistor M25 is turned off, and the differential pair comprised of the transistors M17 and M18 acquires an OFF-state.

In this manner, regardless of the potential of the input signals INPUT1 and INPUT2, since the differential amplifier circuit 29 is driven by the input which is selected through the source follower at the side usually within the input voltage range of the differential amplifier circuit 29, it is possible to realize a wide input voltage range.

Figure 14:
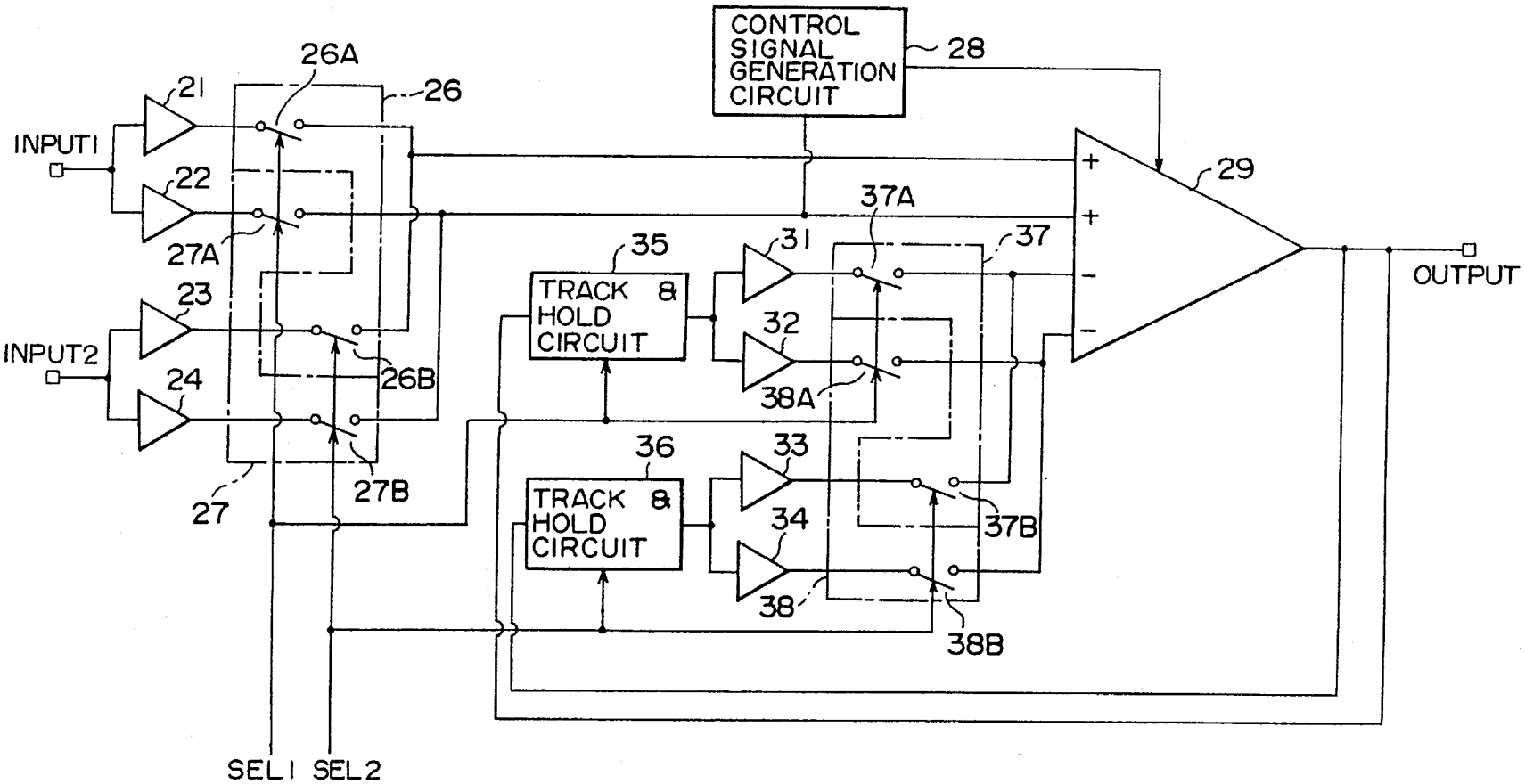
FIG. 14 is a block diagram showing a capacitive load driving circuit according to an eighth embodiment of the present invention.

FIG. 14 is a block diagram showing a capacitive load driving circuit according to an eighth embodiment of the present invention as an example of the first embodiment shown in FIG. 6. After an output of differential amplifier circuit 29 is selected by the selection signal through track and hold circuits 35 and 36, and source followers 31 and 33 of the N-channel MOS FET or source followers 32 and 34 of the P-channel MOS FET, the output of the circuit 29 is supplied to the first and second negative input terminals. In this way, since the track and hold circuits 35 and 36 hold previous data values of the corresponding input signals in a use in which the input signals are outputted by changing over in order such as an output portion of a sample and hold circuit used in a liquid crystal display driving IC (integrated circuit) and the like, it is possible to shorten a settling time of the capacitive load driving circuit when the previous data values have a correlation with new input signals changed over.

Figure 15:
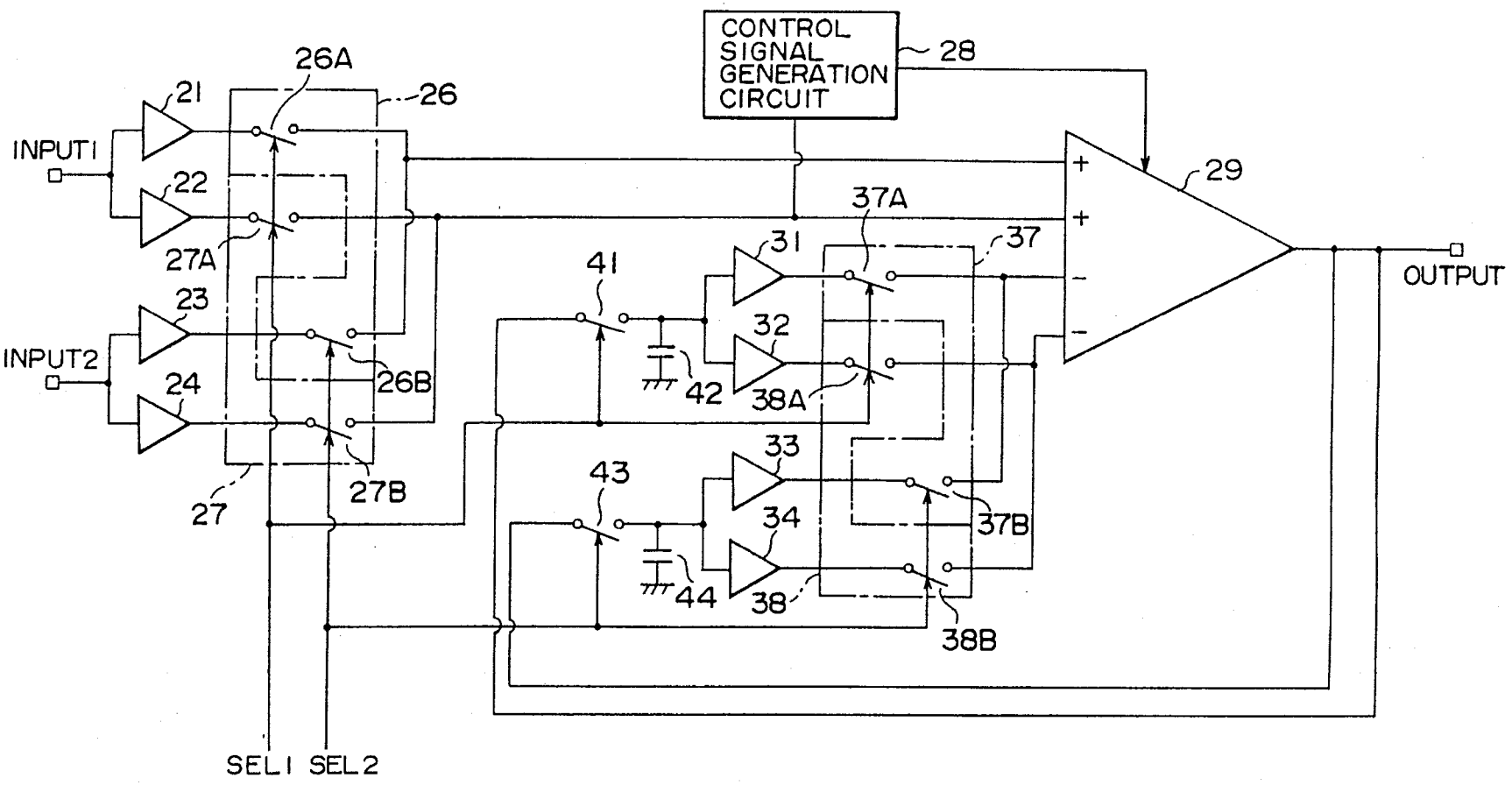
FIG. 15 is a block diagram showing a capacitive load driving circuit according to a ninth embodiment of the present invention.

Even though the track and hold circuits 35 and 36 shown in FIG. 14 are required for accuracy at the time of tracking, an accuracy in the held condition results an in shortening the above-mentioned settling time. Accordingly, the circuits 35 and 36 may be configured by a simple constitution such as analog switches 41 and 43 and capacitors 42 and 44 in the manner of a ninth embodiment shown in FIG. 15, for example. Furthermore, the capacitors 42 and 44 may be in the place of an input capacitance of the source follower.

Figure 16:
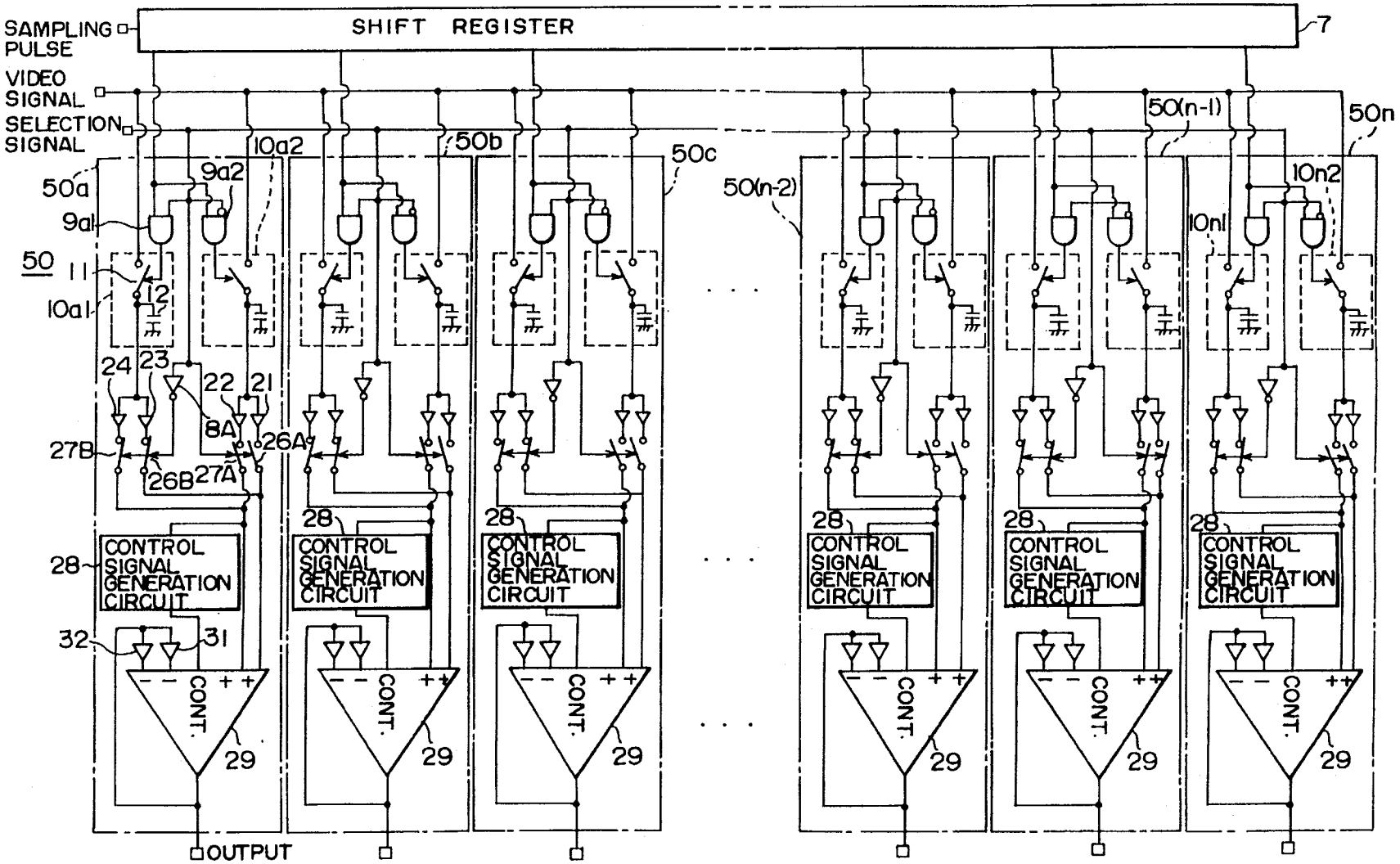
FIG. 16 is a block diagram showing a liquid crystal display device according to a tenth embodiment of the present invention.

FIG. 16 is a block diagram showing a liquid crystal display device using a capacitive load driving circuit according to a tenth embodiment of the present invention. As shown in FIG. 16, the display driving circuit mainly comprises sample and hold circuits and buffer circuits, more particularly, a plurality of sample and hold circuits 10*a*1 and 10*a*2 twice as many as pixels necessary for one horizontal scanning line, a shift register 7 as sampling pulse transfer means, first and second switches 26 and 27 for selecting any of first and second selection signals SEL1 and SEL2 and an output of the sample and hold circuit under the held condition, and a buffer circuit 29 for driving a display main body by a selected signal.

As shown in FIG. 16, output signals of the sample and hole circuits 10a1 and 10a2 are selected by the selection signals SEL1 And SEL2 in the switches 26A and 26B through the source followers 21 and 23 each comprised of the N-channel MOS FET, and at the same time, the output signals of the sample and hole circuits 10*a*1 and 10*a*2 are selected by the selection signals SEL1 and SEL2 in the switches 27A and 27B through the source followers 22 and 24 each comprised of the P-channel MOS FET. The input signals selected in the switches 26A and 26B are supplied to a first positive input terminal of the differential amplifier circuit 29, and the input signals selected in the switches 27A and 27B are supplied to a second positive input terminal and to the control signal generation circuit 28. An output of the differential amplifier circuit 29 is supplied through the source follower 31 of the N-channel MOS FET and the source follower 32 of the P-channel MOS FET to first and second negative input terminals, respectively. The differential amplifier circuit 29 is operated by the control signal occurring in the control signal generation means 28 after selecting any one of two pair of the differential inputs supplied to the differential amplifier circuit 29.

Furthermore, when the capacitive load driving circuit according to the tenth embodiment of the present invention is applied to switches and buffer circuits for selecting outputs of the sample and hold circuits in the liquid crystal display driving circuit as shown in FIG. 2, for example, since the driving circuit does not receive an influence of errors by the channel charges when the switch for selecting the output of the sample and hold circuit is turned off, and an influence of a signal component of the past sampling occurring by the input capacitance of the buffer circuit, it is possible to realize a liquid crystal display driving circuit having a wide operation voltage range. If such liquid crystal display driving device is used in a liquid crystal display device, since signals of the scanning lines in the past sampling do not leak in the display so as to reduce an influence of errors, it is possible to realize a very accurate display. Furthermore, since it is unnecessary to increase the power voltage source, the power consumption does not increase.

What is claimed is:

1. A capacitive load driving circuit comprising:

first through n-th input terminals for respectively receiving first through n-th input signals, where n is an integer greater than or equal to two;

first through n-th source followers formed by first through n-th field effect transistors (FET) each having an input terminal which is respectively connected to said first through n-th input terminals and formed of a first conductive type semiconductor;

(n+1)-th through 2n-th source followers formed by (n+1)-th through 2n-th FET each having an input terminal which is respectively connected to said first through n-th input terminals and formed of a second conductive type semiconductor;

a differential amplifier circuit having two pairs of positive inputs and negative inputs, namely, a first positive input, a first negative input, a second positive input and a second negative input, and for operating by a signal supplied to any pair of positive and negative inputs by a control signal;

a (2n+1)-th source follower formed by the first conductive type semiconductor FET and inputting an output of said differential amplifier circuit to said first negative input;

a (2n+2)-th source follower formed by the second conductive type semiconductor FET and inputting said output of said differential amplifier circuit to said second negative input;

first switch means for selecting any of outputs from said first through n-th source followers formed by the first conductive type FET on the basis of a selection signal;

second switch means for selecting any of outputs from said (n+1)-th through 2n-th source followers formed by the second conductive type FET on the basis of said selection signal; and control signal generation means for generating said control signal on the basis of an operation potential after inputting any of outputs from said first switch means and said second switch means, wherein said output of said first switch means is supplied to said first positive input of said differential amplifier circuit, said output of said second switch means is supplied to said second positive input of said differential amplifier circuit, said output of said (2n+1)-th source follower is supplied to said first negative input of said differential amplifier circuit, and said output of said (2n+2)-th source follower is supplied to said second negative input of said differential amplifier circuit.

2. A capacitive load driving circuit comprising:

first through n-th input terminals for respectively receiving first through n-th input signals, where n is an integer greater than or equal to two;

first through n-th source followers formed by first through n-th field effect transistors (FET) each having an input terminal which is respectively connected to said first through n-th input terminals and formed of a first conductive type semiconductor;

(n+1)-th through 2n-th source followers formed by (n+1)-th through 2n-th FET each having an input terminal which is respectively connected to said first through n-th input terminals and formed of a second conductive type semiconductor;

a differential amplifier circuit having two pairs of positive inputs and negative inputs, namely, a first positive input, a first negative input, a second positive input and a second negative input, and for operating by a signal supplied to any pair of positive and negative inputs by a control signal;

first through n-th track and hold means for inputting an output of said differential amplifier circuit;

(2n+1)-th through 3n-th source followers formed by the first conductive type semiconductor FET and inputting an output of said first through n-th track and hold means;

(3n+1)-th through 4n-th source followers formed by the second conductive type semiconductor FET and inputting said output of said first through n-th track and hold means;

first switch means for selecting any of outputs from said first through n-th source followers formed by the first conductive type FET on the basis of a selection signal;

second switch means for selecting any of outputs from said (n+1)-th through 2n-th source followers formed by the second conductive type FET on the basis of said selection signal;

third switch means for selecting any of outputs from said (2n+1)-th through 3n-th source followers formed by the first conductive type FET on the basis of said selection signal;

fourth switch means for selecting any of outputs from said (3n+1)-th through 4n source followers formed by the second conductive type FET on the basis of said selection signal and control signal generation means for generating said control signal on the basis of an operation potential after inputting any of outputs from said first switch means and said second switch means, wherein an output of said first switch means is supplied to said first positive input of said differential amplifier circuit, an output of said second switch means is supplied to said second positive input of said differential amplifier circuit, an output of said third switch is supplied to said first negative input of said differential amplifier circuit, an output of said fourth switch means is supplied to said second negative input of said differential amplifier circuit, and said first through n-th track and hold means perform tracking and holding on the basis of said selection signal.

3. The capacitive load driving circuit according to claim 2, wherein said track and hold circuit is comprised of switch means and a capacitance.

4. A capacitive load driving circuit comprising:

first through n-th input terminals for respectively receiving first through n-th input signals, where n is an integer greater than or equal to two;

first through n-th emitter followers formed by first through n-th transistors each having an input terminal which is respectively connected to said first through n-th input terminals and formed of a first conductive type semiconductor;

(n+1)-th through 2n-th through 2n-th emitter followers formed by (n+1)-th through 2n-th transistors each having an input terminal which is respectively connected to said first through n-th input terminals and formed of a second conductive type semiconductor;

a differential amplifier circuit having two pairs of positive inputs and negative inputs, namely, a first positive input, a first negative input, a second positive input and a second negative input, and for operating by a signal supplied to any pair of positive and negative inputs by a control signal;

a(2n+2)-th emitter follower formed by the first conductive type semiconductor and inputting an output of said differential amplifier circuit;

a(2n+2)-th emitter follower formed by the second conductive type semiconductor and inputting said output of said differential amplifier circuit;

first switch means for selecting any of outputs from said first through n-th emitter followers formed by the first conductive type transistor on the basis of a selection signal;

second switch means for selecting any of outputs from said (n+1)-th through 2n-th emitter followers formed by the second conductive type transistor on the basis of said selection signal; and control signal generation means for generating said control signal on the basis of an operation potential after inputting any of outputs from said first switch means and said second switch means, wherein said output of said first switch means is supplied to said first positive input of said differential amplifier circuit, said output of said second switch means is supplied to said second positive input of said differential amplifier circuit, said output of said (2n+1)-th emitter follower is supplied to said first negative input of said differential amplifier circuit, and said output of said (2n+2)-th emitter follower is supplied to said second negative input of said differential amplifier circuit.

5. A capacitive load driving circuit comprising:

first through n-th input terminals for respectively receiving first through n-th input signals;

first through n-th emitter followers formed by first through n-th transistors each having an input terminal which is respectively connected to said first through n-th input terminals and formed of a first conductive type semiconductor, where n is an integer greater than or equal to two;

(n+1)-th through 2n-th emitter followers formed by (n+1)-th through 2n-th transistors each having an input terminal which is respectively connected to said first through n-th input terminals and formed of a second conductive type semiconductor;

a differential amplifier circuit having two pairs of positive inputs and negative inputs, namely, a first positive input, a first negative input, a second positive input and a second negative input, and for operating by a signal supplied to any pair of positive and negative inputs by a control signal;

first through n-th track and hold means for inputting an output of said differential amplifier circuit;

(2n+1)-th through 3n-th emitter followers formed by the first conductive type semiconductor transistor and inputting an output of said first through n-th track and hold means;

(3n+1)-th through 4n-th emitter followers formed by the second conductive type semiconductor transistor and inputting said output of said first through n-th track and hold means;

first switch means for selecting any of outputs from said first through n-th emitter followers formed by the first conductive type transistor on the basis of a selection signal;

second switch means for selecting any of outputs from said (n+1)-th through 2n-th emitter followers formed by the second conductive type transistor on the basis of said selection signal;

third switch means for selecting any of outputs from said (2n+1)-th through 3n-th emitter followers formed by the first conductive type transistor on the basis of said selection signal;

fourth switch means for selecting any of outputs from said (3n+1)-th through 4n-th emitter followers formed by the second conductive type transistor on the basis of said selection signal; and control signal generation means for generating said control signal on the basis of an operation potential after inputting any of outputs from said first switch means and said second switch means, wherein an output of said first switch mean sis supplied to said first positive input of said differential amplifier circuit, an output of said second switch means is supplied to said second positive input of said differential amplifier circuit, an output of said third switch is supplied to said first negative input of said differential amplifier circuit, an output of said fourth switch means is supplied to said second negative input of said differential amplifier circuit, and said first through n-th track and hold means perform tracking and holding on the basis of said selection signal.

6. The capacitive load driving circuit according to claim 5, wherein said track and hold circuit is comprised of switch means and capacitance.

7. A liquid crystal display device comprising a plurality of pixels, a liquid crystal display in which signal lines for selectively supplying a video signal to each of said pixels are formed and scanning lines intersecting said signal lines are arranged, first through n-th sample and hold circuits for supplying said video signal to said signal lines after sampling, where n is an integer greater than or equal to two, a capacitive load driving circuit for driving said signal lines after selecting any of outputs of said first through n-th sample and hold circuits, and a selection circuit for selecting any of said scanning lines, where said capacitive load driving circuit comprises;

first through n-th input terminals for respectively receiving first through n-th input signals;

first through n-th source followers formed by first through n-th field effect transistors (FET) each having an input terminal which is respectively connected to said first through n-th input terminals and formed of a first conductive type semiconductor;

(n+1)-th through 2n-th source followers formed by (n+1)-th through 2n-th FET each having an input terminal which is respectively connected to said first through n-th input terminals and formed of a second conductive type semiconductor;

a differential amplifier circuit having two pairs of positive inputs and negative inputs, namely, a first positive input, a first negative input, a second positive input and a second negative input, and for operating by a signal supplied to any pair of positive and negative inputs by a control signal;

a (2n+1)-th source follower formed by the first conductive type semiconductor FET and inputting an output of said differential amplifier circuit;

a (2n+2)-th source follower formed by the second conductive type semiconductor FET and inputting said output of said differential amplifier circuit;

first switch means for selecting any of outputs from said first through n-th source followers formed by the first conductive type FET on the basis of a selection signal;

second switch means for selecting any of outputs from said (n+1)-th through 2n-th source followers formed by the second conductive type FET on the basis of said selection signal; and control signal generation means for generating said control signal on the basis of an operation potential after inputting any of outputs from said first switch means and said second switch means, wherein said output of said first switch means is supplied to said first positive input of said differential amplifier circuit, said output of said second switch means is supplied to said second positive input of said differential amplifier circuit, said output of said (2n+1)-th source follower is supplied to said first negative input of said differential amplifier circuit, and said output of said (2n+2)-th source follower is supplied to said second negative input of said differential amplifier circuit.

* * * * *